US009595414B2

(12) United States Patent
Reichmann et al.

(10) Patent No.: US 9,595,414 B2
(45) Date of Patent: Mar. 14, 2017

(54) MAGNETIC FIELD GENERATION APPARATUS FOR A MAGNETRON TUBE, MAGNETRON AND METHOD FOR REPLACING AN OLD MAGNETRON TUBE OF A MAGNETRON WITH A NEW MAGNETRON TUBE

(71) Applicant: MUEGGE GMBH, Reichelsheim (DE)

(72) Inventors: Markus Reichmann, Michelstadt-Rehbach (DE); Klaus J. Muegge, Reichelsheim (DE)

(73) Assignee: MUEGGE GMBH, Reichelsheim (DE)

( * ) Notice: Subject to any disclaimer, the term of this patent is extended or adjusted under 35 U.S.C. 154(b) by 0 days.

(21) Appl. No.: 14/906,299

(22) PCT Filed: Aug. 8, 2014

(86) PCT No.: PCT/EP2014/067060
§ 371 (c)(1),
(2) Date: Jan. 20, 2016

(87) PCT Pub. No.: WO2015/018925
PCT Pub. Date: Feb. 12, 2015

(65) Prior Publication Data

US 2016/0163493 A1 Jun. 9, 2016

(30) Foreign Application Priority Data

Aug. 9, 2013 (DE) ..... 10 2013 108 667

(51) Int. Cl.
*H01J 25/50* (2006.01)
*H01J 23/10* (2006.01)
(Continued)

(52) U.S. Cl.
CPC ..... *H01J 23/10* (2013.01); *H01F 7/0273* (2013.01); *H01J 23/12* (2013.01); *H01J 25/50* (2013.01); *H01J 25/587* (2013.01)

(58) Field of Classification Search
USPC ..... 315/39.51, 39.53, 39.65, 39.71, 85, 315/111.41
See application file for complete search history.

(56) References Cited

U.S. PATENT DOCUMENTS

| | | | |
|---|---|---|---|
| 2,876,376 | A | 3/1959 | Frits |
| 2,947,901 | A | 8/1960 | Hobbs |
| 4,104,559 | A | 8/1978 | Hobbs |

FOREIGN PATENT DOCUMENTS

| | | | |
|---|---|---|---|
| CA | 670095 | A | 9/1963 |

OTHER PUBLICATIONS

International Search Report (Nov. 24, 2014) for corresponding International application No. PCT/EP2014/067060.

*Primary Examiner* — Douglas W Owens
*Assistant Examiner* — Jianzi Chen
(74) *Attorney, Agent, or Firm* — WRB-IP LLP

(57) ABSTRACT

A magnetic field generation apparatus is provided for a magnetron including a permanent magnet arrangement and a magnetic field conductor device. The magnetic field conductor device has a diverting element. The diverting element, which includes a plurality of rectangular diverting segments, is arranged detachably on the magnetic field generation apparatus during maintenance work in order to deflect a magnetic field generated by the permanent magnet arrangement away from further components of the magnetic field generation apparatus and components of the magnetron. A magnetron includes a magnetron tube and such a magnetic field generation apparatus. In a method for replacing an old magnetron tube of such a magnetron with a new magnetron tube, the diverting element is arranged on the
(Continued)

magnetic field generation apparatus, and the old magnetron tube is removed from the magnetron and replaced with the new magnetron tube in order to then remove the diverting element again.

11 Claims, 5 Drawing Sheets

(51) Int. Cl.

| | |
|---|---|
| ***H01J 25/587*** | (2006.01) |
| ***H01J 23/12*** | (2006.01) |
| ***H01F 7/02*** | (2006.01) |

MAGNETIC FIELD GENERATION APPARATUS FOR A MAGNETRON TUBE, MAGNETRON AND METHOD FOR REPLACING AN OLD MAGNETRON TUBE OF A MAGNETRON WITH A NEW MAGNETRON TUBE

BACKGROUND AND SUMMARY

The invention relates to a magnetic field generation apparatus for a magnetron tube having a permanent magnet arrangement and a magnetic field conductor device. The invention further relates to a magnetron having a magnetron tube and a magnetic field generation apparatus. The invention also relates to a method for replacing an old magnetron tube of a magnetron with a new magnetron tube.

Magnetrons serve for generating electromagnetic radiation with frequencies in the microwave range. Magnetrons are used as microwave generators in radar technology and microwave ovens, for example. The magnetic field generation apparatus and the magnetron tube are the essentials components of magnetrons. The magnetron tube is a vacuum tube having an anode and having a cathode arranged coaxially to the anode, wherein a technical vacuum is formed in an interspace between the anode and the cathode. The magnetic field generation apparatus generates a magnetic field in the evacuated region, which field is essentially axially orientated with respect to the cathode and the anode. Permanent magnets or electromagnets can be used for generating the magnetic field.

The provision of the required magnetic field by means of permanent magnets comes with several advantages. The construction space for the magnetron is usually reduced when using permanent magnets in place of electromagnets. Moreover, power electronics is not required for suppling the electromagnets. Further, when using permanent magnets, a static, non-oscillating magnetic field can be provided, which is why a particularly interference-low electromagnetic microwave field can be generated. For financial reasons, magnetrons having permanent magnets have so far only been used in magnetrons with less power of up to 10 kW. In the case of magnetrons having magnetron tubes of greater power, the magnetron tubes are re-processed and, for example, used hot cathodes are replaced with new hot cathodes and this the re-processed magnetron tubes can be re-used again.

The disassembly of the magnetron tube from the magnetic generation field apparatus surrounding the magnetron tube usually requires switching-off the magnetic field in order to be able to take out the magnetron tube comprising magnetic components. For this reason, in practice exclusively electromagnets are used in magnetrons having great magnetic field forces, since permanent magnets provide a permanent magnetic field and can not be switched-off.

It is desirable to provide a magnetic field generation apparatus for a magnetron, a magnetron and a method for replacing old magnetron tubes with new magnetron tubes of a magnetron, in which the replacement of the magnetron tubes is possible even if permanent magnets are used for the generation of the required magnetic field.

According to an aspect of the invention, the magnetic field conductor device comprises a diverting element, wherein during maintenance work, the diverting element is detachably arranged on the magnetic field generation apparatus in order to deflect a magnetic field generated by the permanent magnetic arrangement such that the magnetron tube can be removed from the magnetron. The magnetic field generated by the permanent magnet arrangement is practicably also deflected by other components of the magnetic field generation apparatus or by components of the magnetron, respectively. The magnetic field conductor device usually comprises one or multiple iron yokes in order to introduce the magnetic field generated by the permanent magnet assembly into the vacuum space of the magnetron tube essentially in the axial direction of the magnetron tube. The diverting element is magnetically conductive and effects a deflection of the magnetic field provided by the permanent magnet arrangement away from the magnetron tube and from the iron yoke(s) so that the iron yokes and the magnetron tube can be disassembled in a simple manner.

In a particularly advantageous embodiment of the magnetic field generation apparatus, it is provided that the permanent magnet arrangement comprises multiple bar magnets arranged circularly and axis-parallel and that the diverting element is configured cylindrically and arranged around the circularly-arranged bar magnets. According to an aspect of the invention, the magnetron tube of the magnetron can be arranged coaxially to the permanent magnet arrangement, so that the magnetron tube is surrounded by the bar magnets in a circular fashion. By means of a suitably configured magnetic field conductor device, the magnet field provided by the bar magnets is directed to the magnetron tube arranged in the center of the permanent magnet arrangement in such a way that the magnetic field essentially passes through the evacuated region of the magnetron tube essentially in the axial direction of the magnetron tube. This way, according to an aspect of he invention, the magnetron tube can be disassembled readily in that further components of the magnetic field conductor device and the magnetron tube can readily be removed from the inner region of the permanent magnet arrangement after arranging the diverting element around the bar magnets. In addition, particularly strong magnetic fields can be provided in this manner.

According to an aspect of the invention, it is advantageously provided that the diverting element consists of or comprises multiple circularly-arranged diverting segments configured in the type of rectangular plates. Using multiple diverting segments instead of e.g. one cylindrically-configured diverting element and arranging said multiple diverting segments such that an approximately cylindrical diverting element is formed by the diverting segments, allows a particularly simple handling and enables a cost-efficient manufacturing of the diverting element.

According to an aspect of the invention, it is advantageously provided that the permanent magnet arrangement consists of or comprises 42 circularly-arranged cylindrical bar magnets orientated axially-parallel to one another, and that the diverting element consists of or comprises twelve diverting elements which can be arranged cylindrically around the permanent magnet arrangement.

In order to achieve a sufficient magnetic conductivity of the diverting element, it is provided according to an aspect of the invention that the diverting element is made of a high-permeability material. According to an aspect of the invention, iron can advantageously be used for producing the diverting element.

The bar magnets are advantageously made of samarium cobalt.

According to another aspect of the present invention a magnetron having a magnetron tube and a magnetic field generation apparatus is provided, wherein the magnetron is characterized in that the magnetic field generation apparatus is configured as described above.

According to an aspect of the invention, it is advantageously provided that the permanent magnet arrangement is arranged coaxially to the magnetron tube. Advantageously, permanent magnets of the permanent magnet arrangement are arranged circularly around the magnetron tube.

In order to facilitate a simple disassembly of the magnetron tube, it is provided according to an aspect of the invention that the magnetic field conductor device comprises a first yoke element, the third yoke element comprising a fixing device for fixing the diverting element. According to an aspect of the invention, the first yoke element is also used for directing the magnetic field provided by the magnetic field generation apparatus essentially in the axial direction through the evacuated region of the magnetron tube. Due to the fact that the fixing device is also formed on the first yoke element, the magnetron can be manufactured in an especially simple and cost-efficient manner. According to an aspect of the invention, the fixing device can be a recess that is formed in the first yoke element and adapted to a cross-section of the diverting element, in which the diverting element can be sectionally arranged.

The first yoke element is advantageously configured in an annular shape, wherein the magnetron tube is sectionally arranged in a central region of the annularly-configured first yoke element. Advantageously, the bar magnets of the permanent magnet arrangement are also arranged on the yoke element in an annular manner. The magnetic field passing through the magnetron tube is directed into the bar magnets via the first yoke element or directed into the magnetron tube by the bar magnet via the first yoke element.

According to an aspect of the invention, it is advantageously provided that the magnetic field conducting device comprises a second yoke element, with the magnetron tube being fixed to the second yoke element. The second yoke element is advantageously arranged spaced apart from the first yoke element and, according to an aspect of the invention, bears sectionally against the bar magnets on a surface of the bar magnet opposing the first yoke element. Advantageously, the second yoke element in a central section comprises a recess adapted to the magnetron tube in order that the magnetron tube can be sectionally arranged in the recess and bears against the second yoke element on an edge of the recess. By arranging the magnetron tube in the recess of the first yoke element and by means of the recess of the second yoke element, the magnetron tube can be fixed to the magnetron in a safe and simple manner.

The first yoke element and the second yoke element are advantageously made of iron. For disassembly of the magnetron tube from the magnetron, it is provided according to an aspect of the invention that the second yoke element, is removed after arranging the diverting element on the magnetic field generation apparatus in order that the magnetron tube can readily be taken out the recess of the first yoke element. To this end, the second yoke element is advantageously configured in two pieces in order to facilitate an easier disassembly of the second yoke element.

According to another aspect of the invention, a method is provided for replacing an old magnetron tube of a magnetron as described above with a new magnetron tube, the method characterized in that in a first step the diverting element is arranged on the magnetic field generation apparatus, in a second step fixing means for fixing the magnetron tube on fixing components of the magnetron are released, in a third step the old magnetron tube is removed from the magnetron and replaced with the new magnetron tube, in a fourth step the new magnetron tube is fixed to the fixing components by the fixing means, and in a fifth step the diverting element is removed. The fixing means advantageously is the second yoke element. According to an aspect of the invention, the fixing components can be holding devices, on which the second yoke element can be arranged by means of screws or the like.

Further advantageous embodiments of the invention are described with reference to the exemplary embodiments illustrated in the drawing.

DETAILED DESCRIPTION

Figure 1:
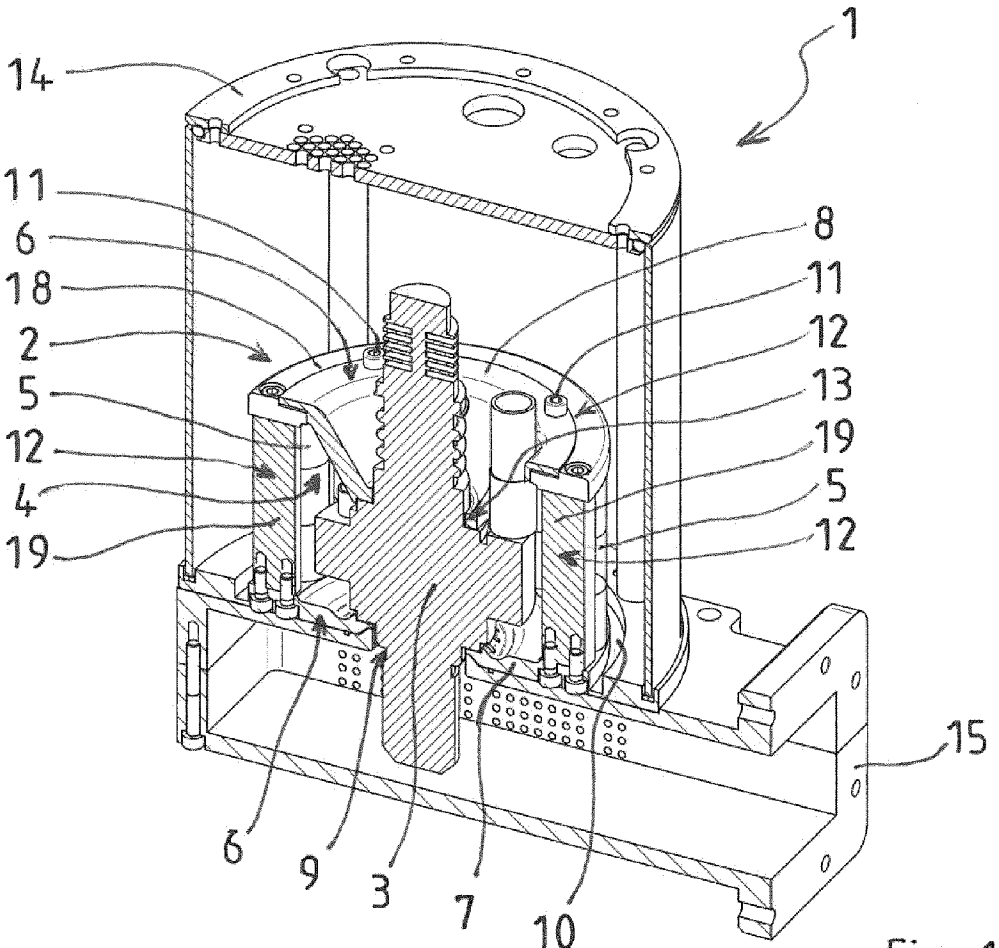
FIG. 1 a schematically illustrated sectional view of a magnetron with bar magnets arranged cylindrically around a magnetron tube, FIG. 2*a* a schematically-illustrated view of the magnetron illustrated in FIG. 1 with diverting segments of a diverting element arranged around the permanent magnet arrangement and with the housing removed.

FIG. 1 schematically shows a sectional view of a magnetron 1 having a magnetic field generation apparatus 2 and a magnetron tube 3, which is only merely illustrated by outer contours.

The magnetic field generation apparatus 2 comprises a permanent magnet arrangement 4 having multiple, circularly-arranged, cylindrically-shaped bar magnets 5 orientated axially parallel. The bar magnets 5 are arranged circularly around the magnetron tube 3.

The magnetic field generation apparatus 2 further comprises a magnetic field conductor device 6 having a first yoke element 7 and a second, two-piece yoke element 8.

The bar magnets 5 are arranged on the first yoke element 7. The first yoke element 7 further comprises a recess 9, in which the magnetron tube 3 is sectionally arranged. Furthermore, a fixing device 10 for receiving a diverting element (not shown) is formed at the first yoke element 7. The fixing device 10 is adapted to a cross-section of the diverting element.

The second yoke element 8 is fixed to a fixing component 12 of the magnetron 1 by means of screws 11. The magnetron tube 3 is sectionally arranged in a recess 13 of the second yoke element 8 and bears against the second yoke element 8.

The magnetic field conductor device 6 and the permanent magnet arrangement 4 of the magnetron 1 are arranged within a housing 14. The magnetron tube 3 protrudes into a rectangular hollow conductor 15, into which are coupled the electromagnetic waves generated by the magnetron tube 3.

Figure 2A:
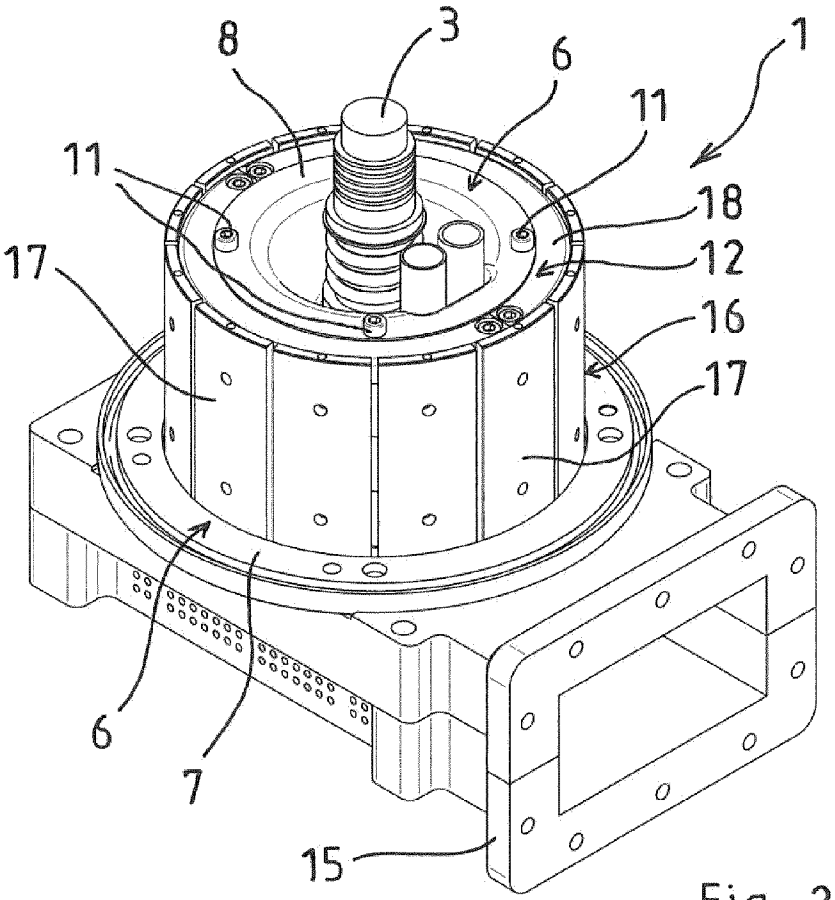
FIG. 2*b* a schematically-illustrated view of the magnetron illustrated in FIG. 2*a* without diverting element, FIG. 3 a schematically-illustrated sectional view of the magnetron illustrated in FIG. 2*a*, FIG. 4 a schematically-illustrated full sectional view of the magnetron illustrated in FIGS. 2*a* and 3.

FIG. 2*a* shows a schematically-illustrated view of the magnetron 1 illustrated in FIG. 1, where the housing 14 has been removed from the magnetron 1. Furthermore, in this illustration, a diverting element 16 in the form of rectangular diverting segments 17 is arranged in the fixing device 10 of the first yoke element 7, in order to be able to remove the second yoke element 8 and the magnetron tube 3 from the magnetron 1. In this way, the magnetic field provided by the bar magnet 5 is deflected from the second yoke element 8 and the magnetron tube 3. In the illustration, individual diverting segments 17 are indicated with a reference numeral merely by way of example.

The magnetron tube 3 can readily be replaced in that after arranging the diverting element 16 in the fixing device 10, the screws 11 are loosened and the second yoke element 8 is removed from the magnetic field conductor device 6. After that, the magnetron tube 3 can readily be pulled out of the recess 9 of the first yoke element 7 and be replaced with a new magnetron tube.

Figure 2B:
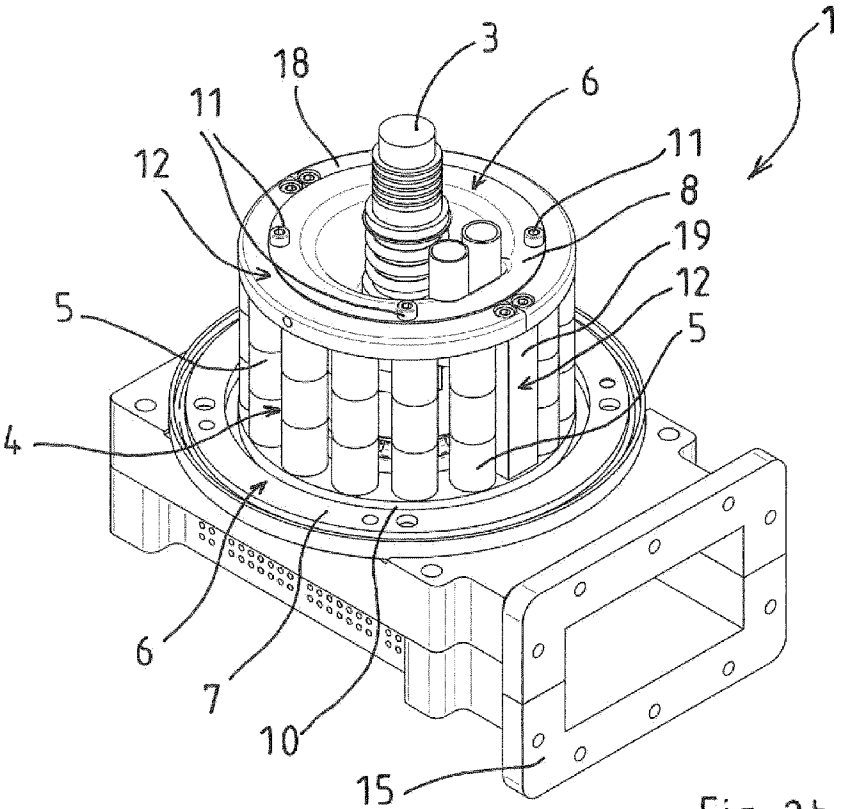

FIG. 2*b* schematically illustrates removed the magnetron 1 illustrated in FIG. 2*a* with the housing 14 and without the diverting element 16. The fixing component 12 comprises a support portion 18, rested against by the second yoke element 8 and to which the second yoke element 8 is screwed. Furthermore, the fixing component 12 comprises support parts 19, which are fixed to the first yoke element 7 and to which the support portion 18 is screwed. In this illustration, individual bar magnets 5 are indicated with a reference numeral merely by way of example.

Figure 3:
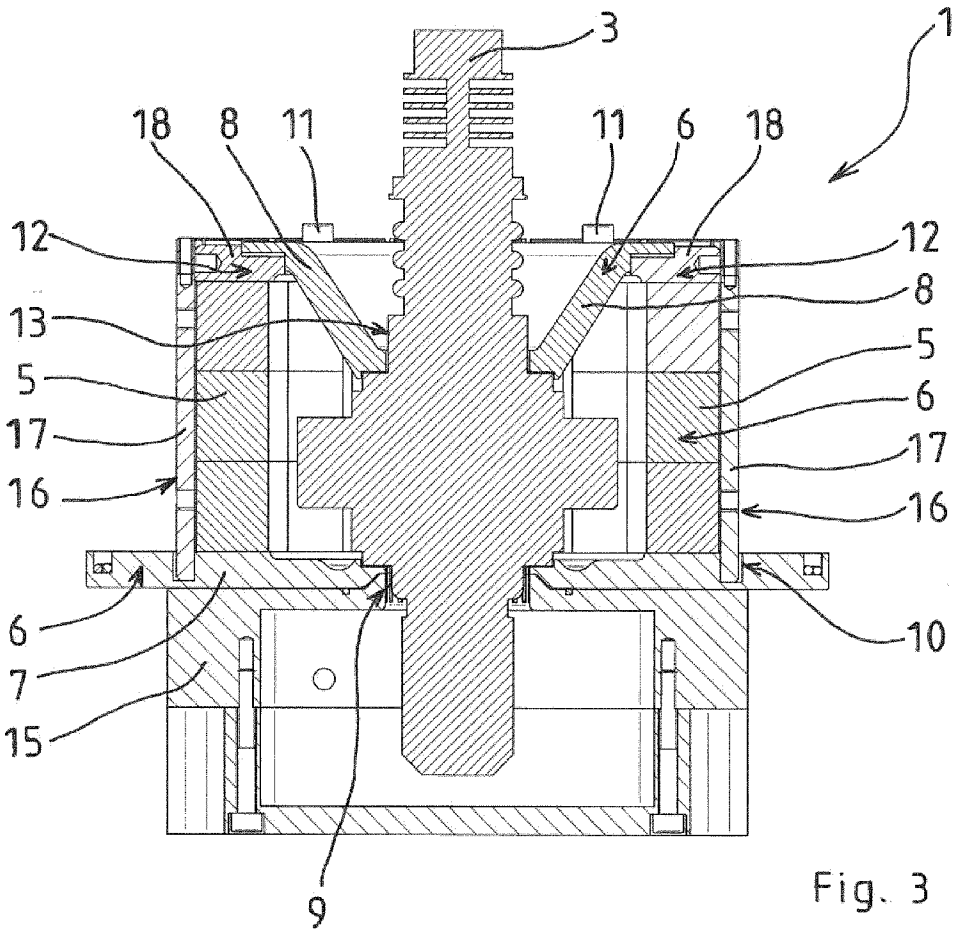
Figure 4:
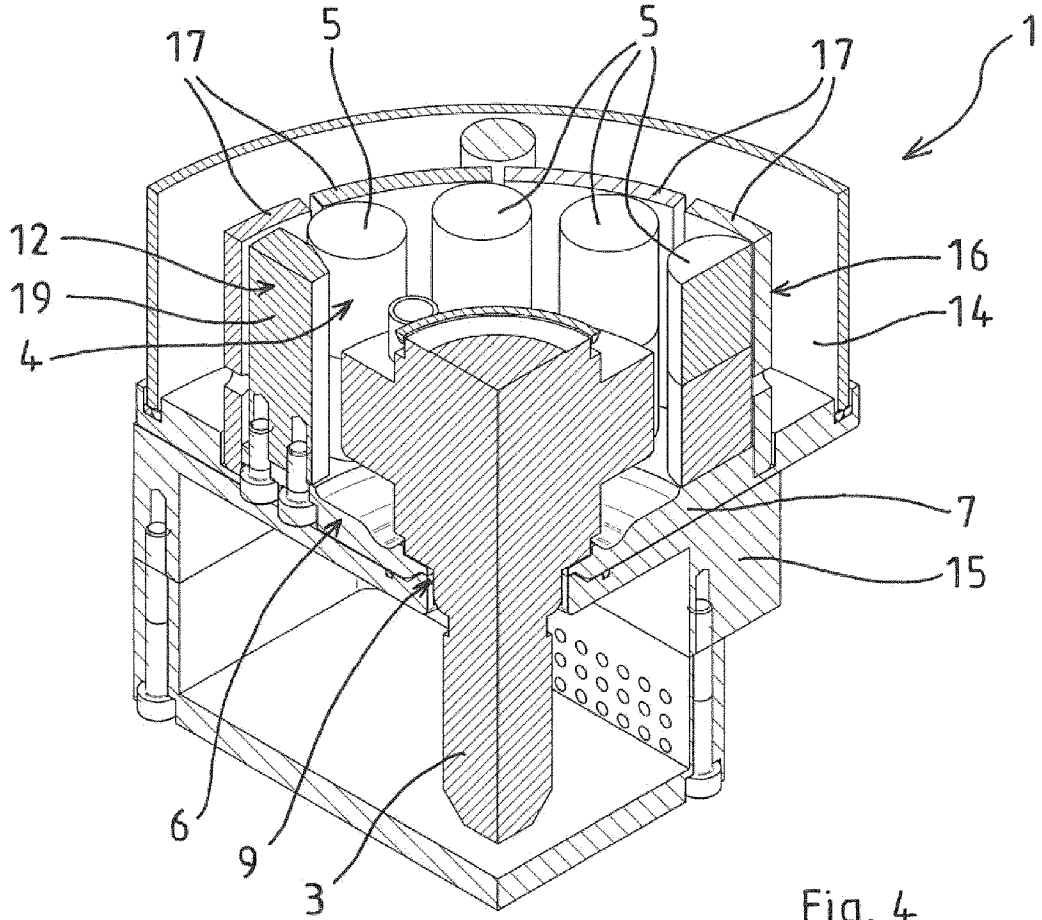

FIG. 3 schematically shows a sectional view of the magnetron 1 illustrated in FIG. 2*a* and FIG. 4 shows a schematically-illustrated full sectional view of the magnetron 1 illustrated in FIG. 1. In FIG. 4, the magnetron is illustrated in a sectional view also below the second yoke element 8, so that only a part of the magnetic field generation apparatus 2 and of the magnetron tube 3 adjacent to the hollow conductor 15 is visibly illustrated.

The invention claimed is:

1. A magnetic field generation apparatus for a magnetron tube having a permanent magnet arrangement and a magnetic field conductor device, wherein the magnetic field conductor device comprises a diverting element, the diverting element being arranged detachably on the magnetic field generation apparatus during maintenance work, in order to deflect a magnetic field generated by the permanent magnetic arrangement such that the magnetron tube can be removed from the magnetron.

2. The magnetic field generation apparatus according to claim 1, wherein the permanent magnet arrangement comprises multiple circularly-arranged bar magnets oriented axis-parallel to one another and wherein the diverting element is configured cylindrically and arranged around the circularly-arranged bar magnets.

3. The magnetic field generation apparatus according to claim 2, wherein the bar magnets are made of samarium cobalt.

4. The magnetic field generation apparatus according to claim 1, wherein the diverting element comprises multiple, circularly-arranged diverting segments each configured in the form of a rectangular plate.

5. The magnetic field generation apparatus according to claim 1, wherein the diverting element comprises a high-permeability material.

6. A magnetron having a magnetron tube and having a magnetic field generation apparatus, wherein the magnetic field generation apparatus is configured according to claim 1.

7. The magnetron according to claim 6, wherein the permanent magnet arrangement is arranged coaxially to the magnetron tube.

8. The magnetron according to claim 6, wherein the magnetic field conductor device comprises a first yoke element, with the first yoke element comprising a fixing device for fixing the diverting element.

9. The magnetron according to claim 6, wherein the magnetic field conductor device comprises a second yoke element, with the magnetron tube being fixed to the second yoke element.

10. A method for replacing an old magnetron tube of a magnetron with a new magnetron tube, the magnetron comprising a magnetron tube and a magnetic field generation apparatus for the magnetron tube, the magnetic field generation apparatus comprising a permanent magnet arrangement and a magnetic field conductor device, wherein the magnetic field conductor device comprises a diverting element, the diverting element being arranged detachably on the magnetic field generation apparatus during maintenance work, in order to deflect a magnetic field generated by the permanent magnetic arrangement such that the magnetron tube can be removed from the magnetron, the method comprising arranging the diverting element on the magnetic field generation apparatus, releasing fixing means for fixing the old magnetron tube on fixing components of the magnetron, removing the old magnetron tube from the magnetron and the old magnetron tube with the new magnetron tube, fixing the new magnetron tube to the fixing components by the fixing means, and removing the diverting element.

11. The method according to claim 10, wherein rectangular diverting segments are arranged in the fixing device of the first yoke element for arranging the diverting element on the magnetic field generation apparatus.

* * * * *